US010774857B2

(12) United States Patent
Neumann et al.

(10) Patent No.: US 10,774,857 B2
(45) Date of Patent: Sep. 15, 2020

(54) METHOD FOR OPERATING A VALVE DEVICE, VALVE DEVICE AND DATA STORAGE MEDIUM WITH A COMPUTER PROGRAM

(71) Applicant: Festo SE & Co. KG, Esslingen (DE)

(72) Inventors: Rudiger Neumann, Ostfildern (DE); Matthias Doll, Wernau (DE); David Rager, Esslingen (DE)

(73) Assignee: FESTO SE & Co. KG, Esslingen (DE)

( * ) Notice: Subject to any disclaimer, the term of this patent is extended or adjusted under 35 U.S.C. 154(b) by 0 days.

(21) Appl. No.: 16/090,985

(22) PCT Filed: Apr. 4, 2017

(86) PCT No.: PCT/EP2017/058012
§ 371 (c)(1),
(2) Date: Oct. 3, 2018

(87) PCT Pub. No.: WO2017/182268
PCT Pub. Date: Oct. 26, 2017

(65) Prior Publication Data

US 2019/0136880 A1 May 9, 2019

(30) Foreign Application Priority Data

Apr. 21, 2016 (DE) ..... 10 2016 206 821

(51) Int. Cl.
*F15B 21/02* (2006.01)
*F15B 11/00* (2006.01)
(Continued)

(52) U.S. Cl.
CPC ..... *F15B 21/02* (2013.01); *F15B 1/033* (2013.01); *F15B 11/006* (2013.01);
(Continued)

(58) Field of Classification Search
CPC ..... F15B 21/02; F15B 21/08; F15B 11/006; F15B 2211/63; F15B 2211/6306; F15B 2211/426; F15B 2211/30575
See application file for complete search history.

(56) References Cited

U.S. PATENT DOCUMENTS 6,354,185 B1 * 3/2002 Sturman ..... F15B 11/006 91/454
7,021,191 B2 * 4/2006 Moler ..... F15B 9/09 91/393

(Continued)

FOREIGN PATENT DOCUMENTS

| | | |
|---|---|---|
| DE | 102005013823 | 11/2005 |
| DE | 102014004877 | 9/2015 |
| WO | WO2016023569 | 2/2016 |

OTHER PUBLICATIONS

Abry et al., "Piston Position Estimation for an Electro-Pneumatic Actuator at Standstill," Control Engineering Practice 41 (2015), pp. 176-185.

*Primary Examiner* — Thomas E Lazo
(74) *Attorney, Agent, or Firm* — Hoffmann & Baron, LLP

(57) ABSTRACT

A method for operating a valve device for supplying compressed air to compressed air consumer includes the steps of: determination of a first fluid pressure in a first section of a fluid passage of a valve assembly, which extends between an inlet port, and a valve element, determination of a second fluid pressure in a second section of the fluid passage of the valve assembly, which extends between the valve element and an outlet port, determination of a flow value for the valve element from the two fluid pressures and of a flow function, relating of the flow value with a presettable volumetric fluid flow rate or mass fluid flow rate for the pressurised fluid, which flow rate is provided for flow through the fluid passage, to a guide value and determination of a
(Continued)

required actuating energy for an actuating device, and provision of the actuating energy to the actuating device.

10 Claims, 2 Drawing Sheets

(51) Int. Cl.

| | |
|---|---|
| ***F15B 1/033*** | (2006.01) |
| ***F15B 11/046*** | (2006.01) |
| ***F15B 11/064*** | (2006.01) |
| ***F15B 13/02*** | (2006.01) |
| ***F15B 15/22*** | (2006.01) |
| ***F15B 15/28*** | (2006.01) |
| ***F15B 21/08*** | (2006.01) |

(52) U.S. Cl.

CPC ..... *F15B 11/046* (2013.01); *F15B 11/064* (2013.01); *F15B 13/021* (2013.01); *F15B 15/22* (2013.01); *F15B 15/2815* (2013.01); *F15B 21/08* (2013.01); *F15B 2211/30575* (2013.01); *F15B 2211/426* (2013.01); *F15B 2211/63* (2013.01); *F15B 2211/6303* (2013.01); *F15B 2211/6306* (2013.01); *F15B 2211/6309* (2013.01); *F15B 2211/6313* (2013.01); *F15B 2211/8855* (2013.01)

(56) References Cited

U.S. PATENT DOCUMENTS

| | | | | |
|---|---|---|---|---|
| 7,353,743 | B2 * | 4/2008 | Bugel | F15B 9/09 91/392 |
| 7,380,398 | B2 * | 6/2008 | Pfaff | F15B 11/006 60/327 |
| 7,406,982 | B2 * | 8/2008 | Pfaff | F15B 11/006 137/596.17 |
| 8,920,575 | B2 * | 12/2014 | Hopponen | F15B 11/0426 134/22.1 |
| 9,279,236 | B2 * | 3/2016 | Zhang | E02F 9/2217 |
| 9,290,912 | B2 * | 3/2016 | Wen | F15B 1/027 |
| 2004/0011192 | A1 * | 1/2004 | Frediani | F15B 11/006 91/459 |
| 2005/0211312 | A1 * | 9/2005 | Pfaff | F15B 11/006 137/596.17 |
| 2006/0090462 | A1 * | 5/2006 | Yoshino | E02F 9/2207 60/468 |
| 2017/0234333 | A1 * | 8/2017 | Wirtl | F15B 11/006 91/459 |

* cited by examiner

METHOD FOR OPERATING A VALVE DEVICE, VALVE DEVICE AND DATA STORAGE MEDIUM WITH A COMPUTER PROGRAM

This application claims priority based on an International Application filed under the Patent Cooperation Treaty, PCT/EP2017/058012, filed Apr. 4, 2017, which claims priority to DE102016206821.0, filed Apr. 21, 2016.

BACKGROUND OF THE INVENTION

The invention relates to a method for operating a valve device for supplying compressed air to a compressed air consumer. The invention further relates to a valve device for operating a compressed air consumer and to a data storage medium with a computer programme for storage in a processing device of a valve device.

According to prior art known to the applicant but not recorded in a printed publication, it is provided in a method for supplying compressed air to a compressed air consumer that a position of a movable component, e.g. of an operating piston of a pneumatic cylinder, along a movement path is determined with the aid of a position sensing system and that a position signal provided by the position sensing system is made available to a processing device, where the position signal is processed, for example in order to obtain from an absolute value of the position signal and/or from a change of the position signal over time at least one information about a movement of the movable component of the compressed air consumer. This information is then used to control a valve assembly assigned to the processing device in order to influence a fluid flow into an operating chamber or out of an operating chamber of the compressed air consumer in such a way that the movable component of the compressed air consumer can be moved to a preset position along the movement path and/or moved at a preset speed along the movement path. On the basis of the position signal of the position sensing system, a valve position of a valve assembly can therefore be controlled in an open or closed loop. In this process, the change of the valve position results, as a function of the pressure conditions at the compressed air consumer and at a compressed air source, in different volumetric fluid flow rates to the compressed air consumer; these are indirectly detected by the processing device via the position signal of the position sensing system and lead to a further adjustment of the valve position.

SUMMARY OF THE INVENTION

The invention is based on the problem of providing a method for operating a valve device, a valve device and a data storage medium with a computer programme for storage in a processing device of a valve device which facilitate an improved provision of compressed air for a compressed air consumer.

For a method of the type referred to above, this problem is solved by the steps listed below: determination of a first fluid pressure in a first section of a fluid passage of the valve assembly, which extends between an inlet port which is provided for a fluidically communicating connection to a fluid source or a fluid sink, and a valve element, determination of a second fluid pressure in a second section of the fluid passage of the valve assembly, which extends between the valve element and an outlet port which is provided for a fluidically communicating connection to a compressed air consumer, determination of a flow value for the valve element based on the two fluid pressures and on a flow function, relating of the flow value with a presettable volumetric fluid flow rate or a mass fluid flow rate for the pressurised fluid, which flow rate is provided for flow through the fluid passage, to receive a guide value and determination of a required actuating energy for an actuating device which is designed for an actuation of the valve element, provision of the actuating energy to the actuating device for adjusting the presettable volumetric fluid flow rate or mass fluid flow rate.

The invention has the objective of being able to adjust a volumetric fluid flow rate or mass fluid flow rate for the compressed air consumer to a presettable volumetric fluid flow rate, using the pressure values determined and knowing the fluid power properties of the valve element used, and of being thus able to have a direct influence on the movement behaviour of the compressed air consumer, which may for example be a pneumatic drive, in particular a pneumatic cylinder or a pneumatic swivel drive. The volumetric fluid flow rate describes the flowing fluid volume per unit of time. In the mass fluid flow rate, the density of the fluid us taken into account as well, whereby the calculating effort can be reduced. In addition, the metrological costs for the open-loop control or the closed-loop control of the compressed air supply for the compressed air consumer can be kept low as well. This is in particular achieved by providing that only pressure sensors designed for detecting fluid pressures in the respective sections of the fluid passage of the valve assembly are required for carrying out the method. Apart from the fact that there is no need for a typically rather cost-intensive position sensing system, further advantages arise from the fact that the pressure sensors can be placed in the immediate vicinity of the valve element and of a processing device designed for evaluating the pressure signals of the pressure sensors and for controlling the actuating device. This being so, the electric connection between the pressure sensors and the processing device can be established using short electric lines.

For carrying out the method, it is provided that the pressure is determined both in the first fluid passage section and in the second fluid passage section, wherein the valve passage sections may be fluidically disconnected from each other or may be fluidically communicating with each other as a function of a functional position of the valve element. It is preferably provided that the valve element can be moved freely between a closed position with disconnection of the two fluid passage sections and an open position with freely communication connection of the two fluid passage sections, depending on a provision of energy, in particular electric or fluidic energy, to an actuating device.

Following the determination of the first fluid pressure and the second fluid pressure, a flow value is determined in a next step, using the fluid pressures and a flow function. The flow function may for example be a set of curves or a characteristic map in which the flow characteristics of the valve element for a fluid flowing through the valve element are stored as a function of the pressure ratios upstream and downstream of the valve element and as a function of a valve position of the valve element. This flow value is then related to a presettable volumetric fluid flow rate or mass fluid flow rate for the pressurised fluid in order to form a guide value. This guide value is needed for determining an actuating energy for the actuating device designed for the actuation of the valve element. The determined actuating energy is then made available to the actuating device for adjusting the presettable volumetric fluid flow rate or mass fluid flow rate.

It is preferably provided that the method described in greater detail above is repeated cyclically in order to thereby obtain a closed-loop control of the volumetric fluid flow rate or mass fluid flow rate for the compressed air consumer.

In this approach the valve device is operated in the manner of a flow control valve, but in contrast to a flow control valve there is no need for a complex and cost-intensive mass flow sensor, because the valve device determines the volumetric fluid flow rate or mass fluid flow rate entirely on the basis of the pressure values provided by the pressure sensors at or in the fluid passage.

Advantageous further developments of the invention are the subject matter of the dependent claims.

It is expedient if the flow value is determined from the flow function, which is set to be interrelated with a quotient of the first fluid pressure and the second fluid pressure, and/or if the actuating energy is determined on the basis of the guide value and a valve characteristic which is determined experimentally in particular. The pressure ratio across the valve element, which can be determined as the quotient of the first fluid pressure and the second fluid pressure, is that variable on the basis of which, independently of a level of fluid pressure in the fluid passage, a precise assignment can be made to flow characteristics of the valve element for a fluid flowing through the valve element. The valve characteristic establishes a correlation between a provision of energy, in particular electric or fluidic energy, to the valve element and a resulting functional position for the valve element. It is preferably provided that the valve characteristic is set in relation to the determined guide value in order to determine therefrom the energy required by the actuating device for obtaining a targeted functional position of the valve element.

It is preferably provided that two independently controllable valve assemblies are provided, their respective second sections of the respective fluid passages being connected to a common outlet port and their inlet ports being connected to different fluid sources or fluid sinks, wherein one of the two valve assemblies is selectively controlled as a function of a pressure differential between the respective inlet port and the common outlet port and of the presettable volumetric fluid flow rate or mass fluid flow rate. Using such an approach, the compressed air consumer can alternatively be connected to different fluid sources or fluid sinks, wherein it is always possible to preset a volumetric fluid flow rate or mass fluid flow rate which is maintained throughout the execution of the method by the suitable control of one of the two valve assemblies. In this process, the volumetric fluid flow rate or mass fluid flow rate can, for example, be constant over a presettable period of time or follow a preset profile, for example in order to induce a constant movement of a compressed air consumer designed as a pneumatic actuator or a preset variable movement of the compressed air consumer. The compressed air source may for example be a local air compressor or a central compressed air system. The compressed air sink may for example be a compressed air outlet into the environment of the valve assembly; this is equipped with a silencer in particular.

In a further development of the invention, it is provided that the compressed air consumer has two fluidically separated, kinematically coupled operating chambers and that each of the operating chambers is assigned two independently controllable valve assemblies, their respective second sections of the respective fluid passages being connected to a common outlet port and their respective inlet ports being connected to different fluid sources or fluid sinks, wherein the two operating chambers are synchronously supplied with compressed air with presettable volumetric fluid flow rates by optional control of the respective valve assemblies. In such a compressed air consumer, which may be designed as a pneumatic cylinder or a pneumatic swivel drive in particular, two operating chambers are fluidically sealed from each other by a movable wall, in particular by an operating piston, and are variable in size owing to the mobility of the wall. As a movement of the wall simultaneously leads to an increase of the one operating chamber and a reduction of the other operating chamber, it is possible to speak of a kinematic coupling of the two operating chambers, the movable wall forming the kinematic coupling element. For a multitude of movement purposes, it is advantageous if there is a synchronous compressed air supply in both operating chambers, the term "compressed air supply" covering both an inflow of compressed air into the operating chamber and an outflow of compressed air from the operating chamber. In the execution of the method according to the invention, synchronous volumetric fluid flow rates are provided for both operating chambers of the compressed air consumer. By way of example, compressed air may flow into one of the two operating chambers, while a discharge of compressed air is provided in the other operating chamber. As a result, the movable wall between the two operating chambers is moved at a presettable speed of movement.

In an advantageous embodiment of the invention, it is provided that a first volumetric fluid flow rate or mass fluid flow rate is preset for a first operating chamber of the compressed air consumer and a second volumetric fluid flow rate or mass fluid flow rate is preset for a second operating chamber of the compressed air consumer in order to obtain a movement profile for the connected compressed air consumer, and/or that a first pressure pattern profile is preset for the first operating chamber and a second pressure pattern profile is preset for the second operating chamber. By presetting the two volumetric fluid flow rates for the two operating chambers of the compressed air consumer, the movement of the wall between the two operating chambers can be predetermined precisely. This in particular applies if during the movement of the wall the ratio between the first volumetric fluid flow rate or mass fluid flow rate and the second volumetric fluid flow rate or mass fluid flow rate remains constant. It is particularly advantageous if the movement of the wall is influenced on the basis of a preset pressure pattern profile, wherein the pressures in the two operating chambers ensue from the volumetric fluid flow rates and the movement of the wall.

The problem of the invention is also solved with a valve device which is designed for the operation of a compressed air consumer. In this, the valve device, comprises a valve assembly in which a fluid passage is formed between an inlet port for a fluidically communicating connection to a fluid source or fluid sink and an outlet port for a fluidically communicating connection to a compressed air consumer, wherein in the valve assembly comprises a valve element which is located movably in the fluid passage for influencing a cross-section of the fluid passage and which is assigned an actuating device for changing a functional position, and the valve device further comprises a processing device for a provision of actuating energy to the actuating device, wherein a first pressure sensor is assigned to a first section of the fluid passage between the inlet port and the valve element and a second pressure sensor is assigned to a second section of the fluid passage between the valve element and the output port.

In a further development of the valve device, it is provided that two independently controllable valve assemblies are provided, their respective second sections of the respective fluid passages being connected to a common outlet port and their inlet ports being connected to different fluid sources or fluid sinks.

In a further embodiment of the valve device, it is provided that the processing device is connected to two pairs of two independently controllable valve assemblies each, the second sections of each of the respective fluid passages being connected in pairs to a common outlet port and a first inlet port of each pair being connected to a fluid source and a second inlet port of each pair being connected to a fluid sink, characterised in that the processing device is designed for a synchronous compressed air supply of the two operating chambers with presettable volumetric fluid flow rates by optional control of the respective valve assemblies.

The valve assembly is preferably designed as a proportional valve, in particular as a fluidically pilot-controlled proportional valve.

The problem of the invention is solved by a data storage medium with a computer programme designed for storage in a processing device of a valve device, wherein the computer programme, if executed in a processor of the processing device, induces a method according to the invention. The data storage medium may be a portable storage medium, such as a CD, a DVD or a UBS memory. Alternatively, the data storage medium may be designed as a drive or a solid-state memory of a data server, in which a multitude of different data are stored; these can be accessed remotely by the processing device, in particular in the form of a cloud.

BRIEF DESCRIPTION OF THE DRAWINGS

Advantageous embodiments of the invention are illustrated in the drawing, of which.

DETAILED DESCRIPTION OF THE PREFERRED EMBODIMENTS

Figure 1:
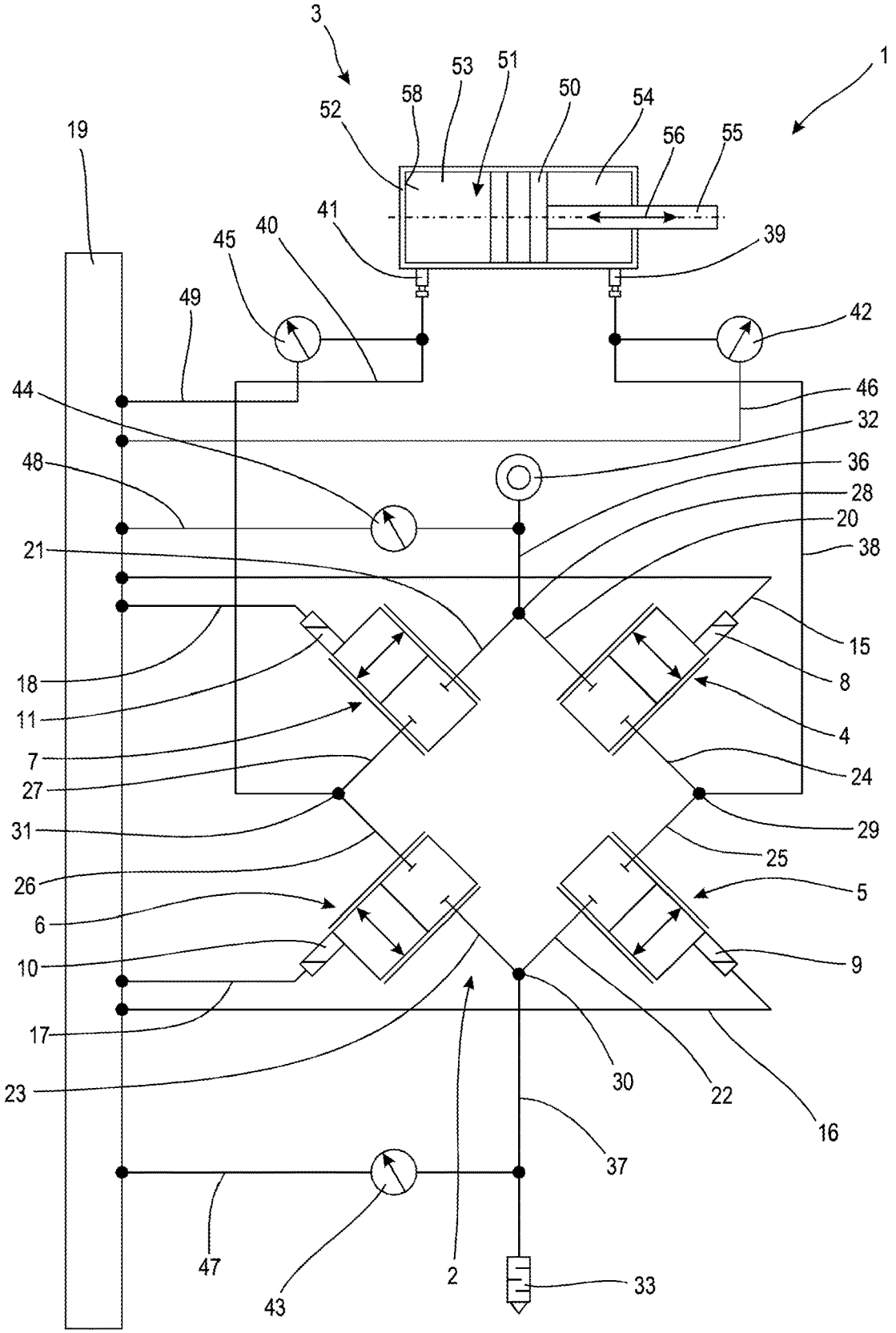
FIG. 1 is a diagrammatic representation of a first embodiment of a fluidic system with a valve device and a compressed air consumer having two kinematically coupled operating chambers.

The fluidic system 1 shown in FIG. 1 is, merely by way of example, designed for providing a linear movement and for this purpose comprises a valve device 2 and a compressed air consumer 3. In the illustrated embodiment, the valve device 2 is implemented as a pneumatic full-bridge circuit with a total of four valve elements 4, 5, 6 and 7 designed as 2/2-way proportional valves, each of the valve elements 4, 5, 6 and 7, merely by way of example, being designed as a solenoid valve with a solenoid drive 8, 9, 10 and 11 as actuating device. In an alternative embodiment not shown in detail, the actuating device can be designed as a piezoelectric, magnetostriction or otherwise suitable drive.

Each of the valve elements 4, 5, 6 and 7 can be switched between two functional positions, in particular a closed-centre position and an open position, if electric energy is suitably applied to the associated solenoid drives 8, 9, 10 and 11. For this purpose, the solenoid drives 8, 9, 10 and 11 are electrically connected via control lines 15, 16, 17 and 18 to a processing device 19, which forms a part of the valve device 2 and comprises a microprocessor or microcontroller by way of example.

Each of the valve elements 4, 5, 6 and 7 is connected to fluidic nodes 28 to 31 via associated fluid lines 20 to 27, forming a valve assembly not designated in detail together with the fluid lines 20 to 27, which are assigned in pairs. The fluid lines 20 to 23 are in each case described as the first section of a fluid passage of the respective valve element 4, 5, 6 and 7. The fluid lines 24 to 27 are, on the other hand, described as the second section of a fluid passage of the respective valve element 4, 5, 6 and 7. The fluid lines 20 and 21 jointly terminate at a fluidic node 28, the fluid lines 22 and 23 jointly terminate at a fluidic node 30, the fluid lines 24 and 25 jointly terminate at a fluidic node 29, and the fluid lines 26 and 27 jointly terminate at a fluidic node 31.

Merely by way of example, the fluidic node 28 is connected to a fluid source 32 via a supply line 36, while the fluidic node 30 is connected via an exhaust air line 37 to a fluid outlet to which a silencer 33 is assigned. The fluidic node 29 forms a first operating port of the valve device 2 and is connected to a fluid port 39 of the compressed air consumer 3 via a first connecting line 38, while the fluidic node 31 forms a second operating port of the valve device 2 and is connected to a fluid port 41 of the compressed air consumer 3 via a second connecting line 40.

Merely by way of example, it is provided that a pressure sensor 42 to 45 designed in each case for a detection of the respective fluid pressure in the associated line 36, 37, 38 and 40 and for a provision of a pressure-dependent sensor signal to the processing device 19 via an associated sensor line 46 to 49 is assigned to the supply line 36, the exhaust air line 37, the first connecting line 38 and the second connecting line 40. In an embodiment not shown in detail, at least one of the pressure sensors is located in a housing for a valve device or outside such a housing.

Merely by way of example, the compressed air consumer 3 is designed as a double-acting pneumatic cylinder in which there is accommodated in a cylinder recess 51 of a cylinder housing 52 an operating piston 50—also described as a movable wall—capable of linear movement and separating a first variable-size operating chamber 53 from a second variable-size operating chamber 54. In the illustrated embodiment, the operating piston 50 is connected to a piston rod 55, which passes through the end face of the cylinder housing 52 and, together with the operating piston 50, can be displaced relative to the cylinder housing 52 along a straight path.

Merely by way of example, it will be described below which steps are required in the fluidic system 1 in order to induce a movement of the operating piston 50 together with the coupled piston rod 55 in accordance with a presettable movement profile. In this example, the operating piston 50 is to be moved, starting from the position shown in FIG. 1, in such a way that an end face of the operating piston 50 comes into contact with an inner surface 58 of the cylinder housing 52, which is located opposite. In this example, the presettable movement profile is designed such that it starts with a constant acceleration of the operating piston 50 to a presettable target speed, followed by a constant movement of the operating piston while maintaining the target speed and finally a deceleration of the operating piston 50 to vanishingly low speed.

For the planned movement of the operating piston 50, a supply of pressurised fluid to the operating chamber 54 is required, while a discharge of fluid from the operating chamber 53 has to be provided. In order to obtain the desired movement profile, the provision of presettable volumetric fluid flow rates is expedient, because this allows the speed of movement for the operating piston to be adjusted precisely. Accordingly, a control of the valve element 4 and the valve element 6 has to be provided for, wherein a fluidically communicating connection between the fluid source 32, the fluidic node 29 and the second fluid port 39 is established via the valve element 4 and a fluidically communicating connection between the first fluid port 41, the fluidic node 31 and the fluid outlet with the silencer 33 is established via the valve element 6.

In order to be able to move the operating piston 50 in accordance with the movement profile described above, the processing device 19 first identifies the sensor signals of the pressure sensors 42 to 45 in order to be able to calculate the pressure ratios across the two valve elements 4 and 6. Using these pressure ratios, a flow value can be determined in a following step in the processing device 19 for each of the valve elements 4, 6 from the two fluid pressures and a flow function. The respectively determined flow value is then related to a presettable volumetric fluid flow rate or mass fluid flow rate which has to be provided to the respective operating chamber 53, 54 in order to obtain the desired movement of the operating piston 50 in accordance with the movement profile. The result of this relation is described as guide value and is required for determining a required actuating energy for the respective solenoid drive 8, 10. The actuating energy for each solenoid drive 8, 10 is determined by relating the guide value to a valve characteristic which is determined experimentally in particular. The actuating energy is then made available to the respective solenoid drives 8, 10 and there results in a movement of the respective valve spools (not designated in detail) of the respective valve elements 4, 6 and thus enables a fluidically communicating connection between the respective fluidic nodes 28 and 29 and/or 31 and 30.

The control of the respective valve elements 4, 6 results in a volumetric fluid flow rate or mass fluid flow rate between the fluid source 32 and the operating chamber 54 and between the operating chamber 53 and the silencer 33 which goes along with a change of the pressures in the respective fluid lines 20 to 27. By means of a cyclically repeated determination of the sensor signals of the pressure sensors 42 to 45 and the subsequent processing of the pressure ratios in accordance with the above procedure, the processing unit 19 can adjust the volumetric fluid flow rates for the two operating chambers 53, 54 of the compressed air consumer 3 in such a way that the desired movement profile for the operating piston 50 is maintained.

Figure 3:
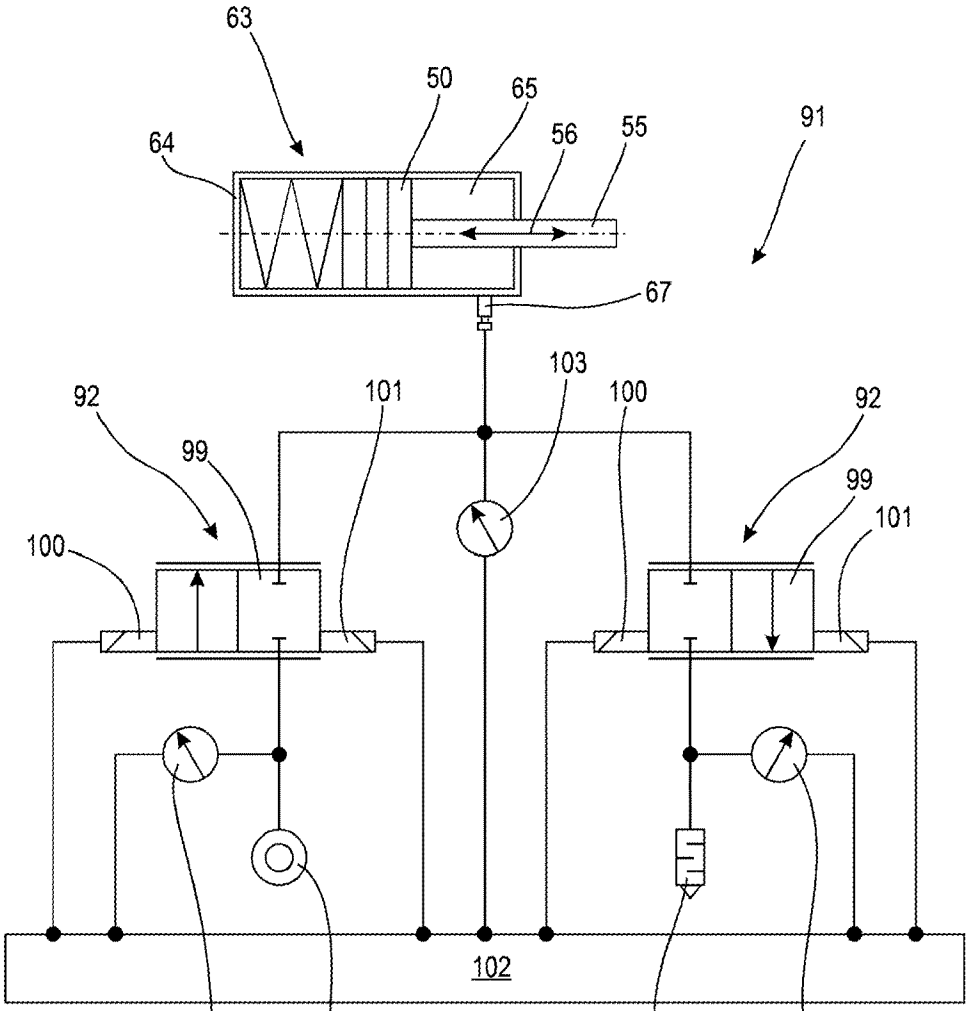
FIG. 3 is a diagrammatic representation of a third embodiment of a fluidic system with a valve device comprising two valve elements and with a compressed air consumer having one operating chamber.
Figure 2:
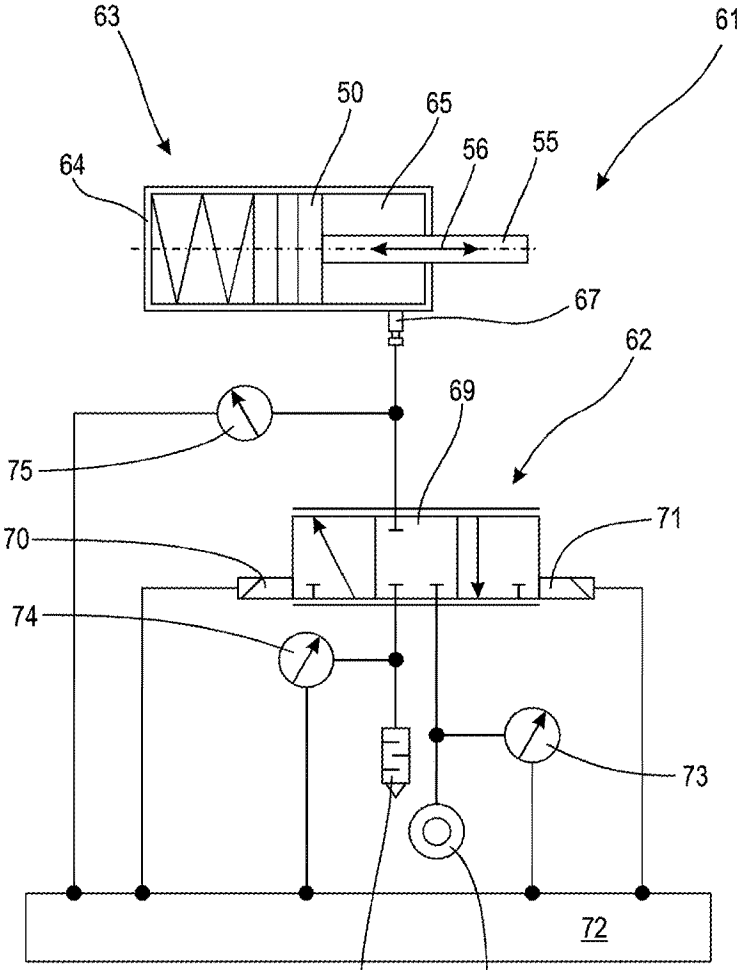
FIG. 2 is a diagrammatic representation of a second embodiment of a fluidic system with a valve device comprising a valve element and with a compressed air consumer having one operating chamber.

The embodiments of fluidic systems 61 and 91 shown in FIGS. 2 and 3 differ from the fluidic system 1 according to FIG. 1 in that the compressed air consumer 63 is—merely by way of example—designed as a single-acting pneumatic cylinder, so that only one operating chamber 65 is formed in the respective cylinder housing 64.

In the embodiment according to FIG. 2, the valve device 62 is by way of example designed as a proportional 3/3-way valve in which, in the switching position shown, which can also be described as inoperative or neutral position, fluidically communicating connections between a fluid source 66, an operating port 67 and a fluid outlet 68 with silencer are blocked. The valve spool 69 of the valve device 62 can be moved into two different functional positions with the aid of the associated solenoid drives 70, 71. In the first functional position, a fluidically communicating connection is established between the fluid source 66 and the operating chamber 65. In the second functional position, a fluidically communicating connection is established between the operating chamber 65 and the fluid outlet 68. The processing device 72 is designed in the same way as the processing device 19 of FIG. 1 and thus facilitates, using sensor signals of the pressure sensors 73, 74, 75, a provision of presettable volumetric fluid flow rates into and out of the operating chamber 65.

In the embodiment according to FIG. 3, the valve devices 92 are designed as proportional 2/2-way valves 100, 101 with valve spools 99 as valve elements and can be controlled individually by the associated processing device 102 for an optional provision of pressurised fluid from the fluid source 66 into the operating chamber 65 or from the operating chamber 65 to the fluid outlet 68. The processing device 102 is designed in the same way as the processing device 19 of FIG. 1 and thus facilitates, using sensor signals of the pressure sensors 103, 104, 105, a provision of presettable fluid flow rates into and out of the operating chamber 65.

The invention claimed is:

1. A method for operating a valve device for supplying compressed air to compressed air consumer, the method comprising the steps of: determination of a first fluid pressure in a first section of a fluid passage of a valve assembly, which extends between an inlet port which is provided for a fluidically communicating connection to a fluid source or a fluid sink, and a valve element, determination of a second fluid pressure in a second section of the fluid passage of the valve assembly, which extends between the valve element and an outlet port which is provided for a fluidically communicating connection to a compressed air consumer, determination of a flow value for the valve element from the two fluid pressures and of a flow function, relating of the flow value with a presettable volumetric fluid flow rate or mass fluid flow rate for the pressurised fluid, which flow rate is provided for flow through the fluid passage, to a guide value and determination of a required actuating energy for an actuating device which is designed for an actuation of the valve element, provision of the actuating energy to the actuating device for adjusting the presettable volumetric fluid flow rate or mass fluid flow rate, wherein the flow value is determined from the flow function set in relation to a quotient of the first fluid pressure and the second fluid pressure, and wherein the actuating energy is determined on the basis of the guide value and of a valve characteristic.

2. The method according to claim 1, wherein two independently controllable valve assemblies are provided, their respective second sections of the respective fluid passages being connected to a common outlet port and their inlet ports being connected to different fluid sources or fluid sinks, wherein one of the two valve assemblies is selectively controlled as a function of a pressure differential between the respective inlet port and the common outlet port and of the presettable volumetric fluid flow rate or mass fluid flow rate.

3. The method according to claim 2, wherein the compressed air consumer has two fluidically separated, kinematically coupled operating chambers, and wherein and that each of the operating chambers is assigned two independently controllable valve assemblies, their respective second sections of the respective fluid passages being connected to a common outlet port and their respective inlet ports being connected to different fluid sources or fluid sinks, and wherein the two operating chambers are synchronously supplied with compressed air with presettable volumetric fluid flow rates by selective control of the respective valve assemblies.

4. The method according to claim 3, wherein a first volumetric fluid flow rate or mass fluid flow rate is preset for a first operating chamber of the compressed air consumer and a second volumetric fluid flow rate or mass fluid flow rate is preset for a second operating chamber of the compressed air consumer in order to obtain a movement profile for the connected compressed air consumer, and/or wherein a first pressure pattern profile is preset for the first operating chamber and a second pressure pattern profile is preset for the second operating chamber.

5. A valve device for operating a compressed air consumer, with a valve assembly in which a fluid passage is formed between an inlet port for a fluidically communicating connection to a fluid source or fluid sink and an outlet port for a fluidically communicating connection to a compressed air consumer, and with a valve element which is located movably in the fluid passage for influencing a cross-section of the fluid passage and which is assigned an actuating device for changing a functional position, and with a processing device for a provision of actuating energy to the actuating device, wherein a first pressure sensor is assigned to a first section of the fluid passage between the inlet port and the valve element and a second pressure sensor is assigned to a second section of the fluid passage between the valve element and the output port and wherein the processing device is designed for an execution of the following steps: determination of a first fluid pressure in the first section of the fluid passage, determination of a second fluid pressure in the second section, determination of a flow value for the valve element from the two fluid pressures and of a flow function, relating of the flow value with a presettable volumetric fluid flow rate or mass fluid flow rate for the pressurised fluid to a guide value and determination of a required actuating energy for an actuating device which is designed for an actuation of the valve element, provision of the actuating energy to the actuating device for adjusting the presettable volumetric fluid flow rate or mass fluid flow rate and wherein the processing device is designed for a determination of the flow value from the flow function set in relation to a quotient of the first fluid pressure and the second fluid pressure and for a determination of the actuating energy on the basis of the guide value and of a valve characteristic.

6. The valve device according to claim 5, wherein two independently controllable valve assemblies are provided, their respective second sections of the respective fluid passages being connected to a common outlet port and their inlet ports being connected to different fluid sources or fluid sinks, and wherein the processing device is designed for a selective controlled of one of the two valve assemblies as a function of a pressure differential between the respective inlet port and the common outlet port and of the presettable volumetric fluid flow rate or mass fluid flow rate.

7. The valve device according to claim 6, wherein the valve device is designed as a proportional valve.

8. The valve device according to claim 7, wherein the valve device is designed as a fluidically pilot-controlled proportional valve.

9. The valve device according to claim 5, wherein the processing device is connected to two pairs of two independently controllable valve assemblies each, the second section of each of the respective fluid passages being connected in pairs to a common outlet port and a first inlet port of each pair being connected to a fluid source and a second inlet port of each pair being connected to a fluid sink, and wherein the processing device is designed for a synchronous compressed air supply of the two operating chambers with presettable volumetric fluid flow rates by optional control of the respective valve assemblies.

10. A data storage medium with a computer program designed for storage in a processing device of a valve device and, if executed in a processor of the processing device, inducing a method comprising the steps of: determination of a first fluid pressure in a first section of a fluid passage of a valve assembly, which extends between an inlet port which is provided for a fluidically communicating connection to a fluid source or a fluid sink, and a valve element, determination of a second fluid pressure in a second section of the fluid passage of the valve assembly, which extends between the valve element and an outlet port which is provided for a fluidically communicating connection to a compressed air consumer, determination of a flow value for the valve element from the two fluid pressures and of a flow function, relating of the flow value with a presettable volumetric fluid flow rate or mass fluid flow rate for the pressurised fluid, which flow rate is provided for flow through the fluid passage, to a guide value and determination of a required actuating energy for an actuating device which is designed for an actuation of the valve element, provision of the actuating energy to the actuating device for adjusting the presettable volumetric fluid flow rate or mass fluid flow rate, wherein the flow value is determined from the flow function set in relation to a quotient of the first fluid pressure and the second fluid pressure, wherein the actuating energy is determined on the basis of the guide value and of a valve characteristic.

* * * * *